US009025300B2

(12) United States Patent
Okuda

(10) Patent No.: US 9,025,300 B2
(45) Date of Patent: May 5, 2015

(54) POSITIONER

(75) Inventor: Kouji Okuda, Tokyo (JP)

(73) Assignee: Azbil Corporation, Tokyo (JP)

( * ) Notice: Subject to any disclaimer, the term of this patent is extended or adjusted under 35 U.S.C. 154(b) by 523 days.

(21) Appl. No.: 13/418,687

(22) Filed: Mar. 13, 2012

(65) Prior Publication Data

US 2012/0248352 A1 Oct. 4, 2012

(30) Foreign Application Priority Data

Mar. 30, 2011 (JP) ..... 2011-076183

(51) Int. Cl.
*H01H 47/00* (2006.01)
*G08C 19/00* (2006.01)
*F23N 5/12* (2006.01)

(52) U.S. Cl.
CPC ..... *G08C 19/00* (2013.01); *F23N 5/123* (2013.01)

(58) Field of Classification Search
CPC ..... F23N 5/123
USPC ..... 361/170
See application file for complete search history.

(56) References Cited

U.S. PATENT DOCUMENTS

| | | | | |
|---|---|---|---|---|
| 4,464,977 | A * | 8/1984 | Brundage | 91/376 R |
| 5,543,627 | A * | 8/1996 | Huggins | 250/551 |
| 6,031,350 | A * | 2/2000 | Sidey | 318/599 |
| 7,556,238 | B2 * | 7/2009 | Seberger | 251/69 |
| 8,087,522 | B2 * | 1/2012 | Stafford et al. | 211/119.003 |

FOREIGN PATENT DOCUMENTS

| | | | |
|---|---|---|---|
| JP | 61-70827 | A | 4/1986 |
| JP | 1-141202 | A | 6/1989 |
| JP | 2002-367069 | A | 12/2002 |
| JP | 2004-226092 | A | 8/2004 |

* cited by examiner

*Primary Examiner* — Stephen W Jackson
(74) *Attorney, Agent, or Firm* — Troutman Sanders LLP

(57) ABSTRACT

A voltage/current converting circuit is provided in a stage prior to a communication circuit. An over-current preventing circuit is incorporated into the voltage/current converting circuit. The voltage/current converting circuit converts a DC voltage signal into a DC electric current signal, and converts an AC voltage signal into an AC electric current signal. Moreover, the voltage/current converting circuit keeps the excessively large electric current that would flow into the internal circuitry thereof to no more than a predetermined electric current value (for example, no more than 30 mA) when the positioner is connected in error to the voltage source side without a load resistance connected.

4 Claims, 11 Drawing Sheets

POSITIONER

CROSS REFERENCE TO RELATED APPLICATIONS

The present application claims priority under 35 U.S.C. §119 to Japanese Patent Application No. 2011-076183, filed Mar. 30, 2011, which is incorporated herein by reference.

FIELD OF TECHNOLOGY

The present invention relates to a positioner for receiving a supply of a DC electric signal through a pair of electric wires from a higher-level system to produce its own operating power supply from the DC electric signal that is supplied, and for controlling the degree of opening of a regulator valve in accordance with a value of the supplied DC electric signal.

BACKGROUND

Conventionally this type of positioner is designed so as to operate with an electric current between 4 and 20 mA (a DC electric signal) sent through a pair of electric wires from a higher-level system. For example, with the regulator valve as a proportional valve if a current of 4 mA is sent from the higher-level system, the opening of the proportional valve is set to 0%, and if a current of 20 mA is sent, then the opening of the proportional valve is set to 100%.

In this case, the supplied electric current from the higher-level system varies in the range of 4 mA (the lower limit electric current value) through 20 mA (the higher limit electric current value), and thus the internal circuitry within the positioner produces an operating power supply itself from an electric current of no more than the 4 mA that can always be secured as an electric current value that is supplied from the higher-level system (See, For Example, Japanese Unexamined Patent Application Publication H1-141202 ("JP '202")).

The opening setting value for the regulator valve is inputted into the positioner by the higher-level system. Moreover, the actual opening value for the regulator valve is obtained through the opening sensor. Consequently, the positioner is able to perform regulator valve fault diagnostics, self-diagnostics, and the like, through performing calculations on the relationship between the opening setting value and the actual opening value for the regulator valve, The provision of such fault diagnostic functions in the positioner makes it possible to increase the functionality of the system at a low cost, through eliminating the need for providing a separate fault diagnosing device (See, for example, JP '202).

For reasons such as these, in recent years there have been proposals for positioners that have, in addition to their actual functions of controlling the degree of opening of the regulator valves, also opening degree transmitting functions, regulator valve fault diagnostics, and functions for sending, to the higher-level system, the results of fault self-diagnostics, and the like. FIG. 8 shows the structure of the critical components in a system that uses a positioner that has a communication function for the higher-level system.

In FIG. 8: 1 is a positioner; 2 is a higher-level device that is connected to the positioner through double-wire transmission lines (a pair of electric wires) L1 and L2; 3 is a communication device that is connected, as necessary, between the transmission lines L1 and L2; 4 is a higher-level system; and 5 is a regulator valve (proportional valve). The positioner 1 is provided with a main circuit 1-1, a communication circuit 1-2, and a constant voltage circuit 1-3. Note that in the present example, the higher-level system 4 is structured from the higher-level device 2 and the communication device 3.

In this system, the higher-level device 2 sends a 4 to 20 mA DC electric current signal I through the transmission lines L1 and L2 to the positioner 1. In the positioner 1, the constant voltage circuit 1-3 generates a constant voltage Pvos from the DC electric current signal I that is sent from the higher-level device 2, and supplies it to the communication circuit 1-2 and the main circuit 1-1. The main circuit 1-1 controls the opening of the proportional valve 5 depending on the value of the DC electric current signal I that is sent from the higher-level device 2. Moreover, it also performs fault diagnostics on the proportional valve 5, fault self-diagnostics, and the like.

The communication device 3 superimposes an AC electric current signal If for communication on to the DC electric current signal I to the positioner 1. In the positioner 1, the communication circuit 1-2 is an electric current inputting-type communication circuit, and extracts the AC electric current signal If that is superimposed on the DC electric current signal I, and sends, to the main circuit 1-1, instructions and data from the communication device 3, sent via the AC electric current signal If. Moreover, the communication circuit 1-2 sends, to the communication device 3, the results of the fault diagnostics on the proportional valve 5 and the results of the fault self-diagnostics from the main circuit 1-1 through changing the voltage between the transmission lines L1 and L2. This type of communication method is disclosed in, for example, Japanese Unexamined Patent Application Publication S61-070827 ("JP '827").

Note that recently there have been requests desiring that fault diagnostics be performed not just on proportional valves, but on ON/OFF valves as well, and there are cases wherein positioners are employed. However, ON/OFF valves use two-level control (all the way open or all the way closed), and so normally an electromagnetic valve is used, and normally a DC voltage signal (normally between 0 and 24 V) is inputted from the pair of electric wires in order to actuate that electromagnetic valve. Given this, it is necessary for the internal circuitry within the positioner that controls the valve opening of the ON/OFF valve to be compatible with this voltage input.

For example, in JP '827, if one of the communicating devices is a positioner and the other communicating device is the higher-level device, then an AC voltage signal for communication is superimposed on a DC voltage signal, that varies over a specific range, and sent from the higher-level device to the positioner side, and, on the positioner side, the DC voltage signal is extracted from the voltage signal that has been received from the higher-level device, and the degree of opening of the regulator valve is controlled based on the value of this DC voltage signal, while, at the same time, the electric current of the line that returns to the higher-level device is varied, making it possible to communicate the degree of valve opening and the fault diagnostics results to the higher-level device side. In this case, the positioner is voltage-input compatible, and can be applied to an ON/OFF valve. Moreover, the power supply of the higher-level system may be of a voltage-outputting type (DO: Digital Output) instead of the current-outputting type (AO: Analog Output), and may also control the opening of a proportional valve.

Note that the voltage output-type system for supplying power is known as a field bus system (referencing, for example, Japanese Unexamined Patent Application Publication 2004-226092 (Japanese Patent Number 4185369)), where a voltage of for example, between 9 and 32 V is supplied by the higher-level system.

Moreover, in the below, a positioner of the type that inputs a DC electric signal shall be termed an electric current inputting-type positioner, and a positioner of the type that inputs a DC voltage signal shall be termed a voltage inputting-type positioner.

In this case, the manufacturer that manufactures and supplies the positioner must prepare two models of positioners, the electric current inputting-type positioner and the voltage inputting-type positioner, in order to be compatible with ON/OFF valves and the compatible with those of the field device-type, while providing a function for communicating with the higher-level system, which increases the manufacturing overhead. Moreover, the voltage inputting-type positioner is expensive because it must be prepared as a type that is different from the typical electric current inputting-type positioner.

Given this, in order to eliminate this overhead, Japanese Unexamined Patent Application Publication 2002-367069 ("JP '069") discloses a positioner of a joint-use type wherein a single model is compatible both with the electric current input from an analog transmission line and a voltage input from a field device transmission line. This joint-use positioner is provided with an interface circuit (I/V block) for connecting to an analog transmission line and an interface circuit (FB block) for connecting with a field device transmission line, and is switched as necessary between the I/V block and the FB block.

However, in the joint-use positioner disclosed in JP '069, the I/V block and the FB block must be provided separately, causing the structure to be complex, and producing a problem wherein it is more expensive than the electric current inputting-type positioner and the voltage inputting-type positioner.

Given this, one of skill in the art can conceive of providing a fixed resistor 1-4 (referencing FIG. 9) in a stage prior to the communication circuit 1-2 in the electric current inputting-type positioner 1 (1A) illustrated in FIG. 8. Note that in a system that uses this positioner 1 (1B), the higher-level device 2 (2B) sends a DC voltage signal V to the positioner 1B. Moreover, the communication device 3 (3B) superimposes an AC voltage signal Vf for communication onto the DC voltage signal V to the positioner 1B. Moreover, the regulator valve 5 (5B) is an electromagnetic valve (ON/OFF valve).

In this positioner 1B, the DC voltage signal V from the higher-level device 213 is converted into an electric current by the fixed resistor 1-4 of a resistance value r, where this electric current is sent to the main circuit 1-1. Through this, the main circuit 1-1 controls the opening/closing of the regulator valve 5*b* based on the value of the electric current that was converted by the fixed resistor 1-4, that is, based on the value of the DC electric current signal V/r. Note that a load resistance 6 that is larger than the resistance value r of the fixed resistor 1-4 is provided in the line L1 to prevent the incursion of the communication signal into the voltage source side. Moreover, the resistance value r of the fixed resistor 1-4 is made small, and the AC voltage signal Vf is converted into a change in the electric current.

However, if this type of positioner 1B were connected in error to a high-voltage power supply without connecting the load resistance 6 (referencing FIG. 10), then, because the resistance value r of the fixed resistor 1-4 is small, an excessively large electric current will flow into the internal circuitry of the positioner 1B, risking damage to the positioner 1B.

Given this, as illustrated in FIG. 11, one may consider having a resistance value r that is larger than that of the resistance value of the fixed resistor 1-4, but when this is done, the impedance relating to the AC voltages signal Vf becomes too high relative to the power supply side, so that the converted electric current becomes small, making communication impossible.

The present invention is to solve such problems, and the object thereof is to provide a voltage inputting-type positioner of an inexpensive structure wherein, through a simple change relative to the common electric current inputting-type positioner, there will be no excessively large electric current even if connected to the voltage supply side without connecting a load resistance, so that communication will also be possible without impediment.

SUMMARY

A positioner for receiving a supply of a DC electric signal through a pair of electric wires from a higher-level system to produce its own operating power supply from the DC electric signal that is supplied, and for controlling the degree of opening of a regulator valve in accordance with a value of the supplied DC electric signal, includes a current inputting-type communication circuit for receiving an AC electric signal sent from the higher-level system superimposed on the DC electric signal; and a voltage/current converting circuit, provided in a stage prior to the communication circuit, for converting the voltage into an electric current and sending the electric current to the communication circuit if the DC electric signal from the higher-level system is a voltage; wherein: the voltage/current converting circuit is provided with an over-current preventing circuit for preventing the flow of an electric current higher than a specific electric current value.

Given the examples of the present invention, when an AC voltage signal (an AC electric signal) is sent from the higher-level system, superimposed on a DC voltage signal (a DC electric signal), the voltage/current converting circuit converts the DC voltage signal into a DC electric current signal, and the AC voltage signal into an AC electric current signal. The AC voltage signal that has been converted by the voltage/current converting circuit is sent to the electric current inputting-type communication circuit.

Moreover, if, in the examples of the present invention, the positioner is connected in error to the voltage source side without connecting a load resistance, an excessively large electric current tries to flow into the internal circuitry, but this excessively large electric current can be held to being below a specific electric current value by an over-current preventing circuit.

Note that a bypass circuit may be connected in parallel to the voltage/current converting circuit, and a switch for enabling/disabling the parallel connection of the bypass circuit to the voltage/current converting circuit may be provided. In this case, the voltage/current converting circuit will cease to function when the parallel connection of the bypass circuit with the voltage/current converting circuit is enabled, producing an electric current inputting-type positioner.

In the examples of the present invention, in the stage prior to the communication circuit, a voltage/current converting circuit is provided for converting the voltage into a current and sending the current to the communication circuit when the DC electric signal from the higher-level system is a voltage, and the voltage/current converting circuit is structured through the provision of an over-current preventing circuit, and thus, a simple change to a conventional electric current inputting-type positioner enables the provision of a voltage inputting-type positioner of an inexpensive structure wherein there will be no excessively large current, and there will be no impediment to communication, even if connected in error to the voltage source side without connecting a load resistance.

DETAILED DESCRIPTION

Examples according to the present invention will be explained below in detail, based on the drawings.

Figure 1:
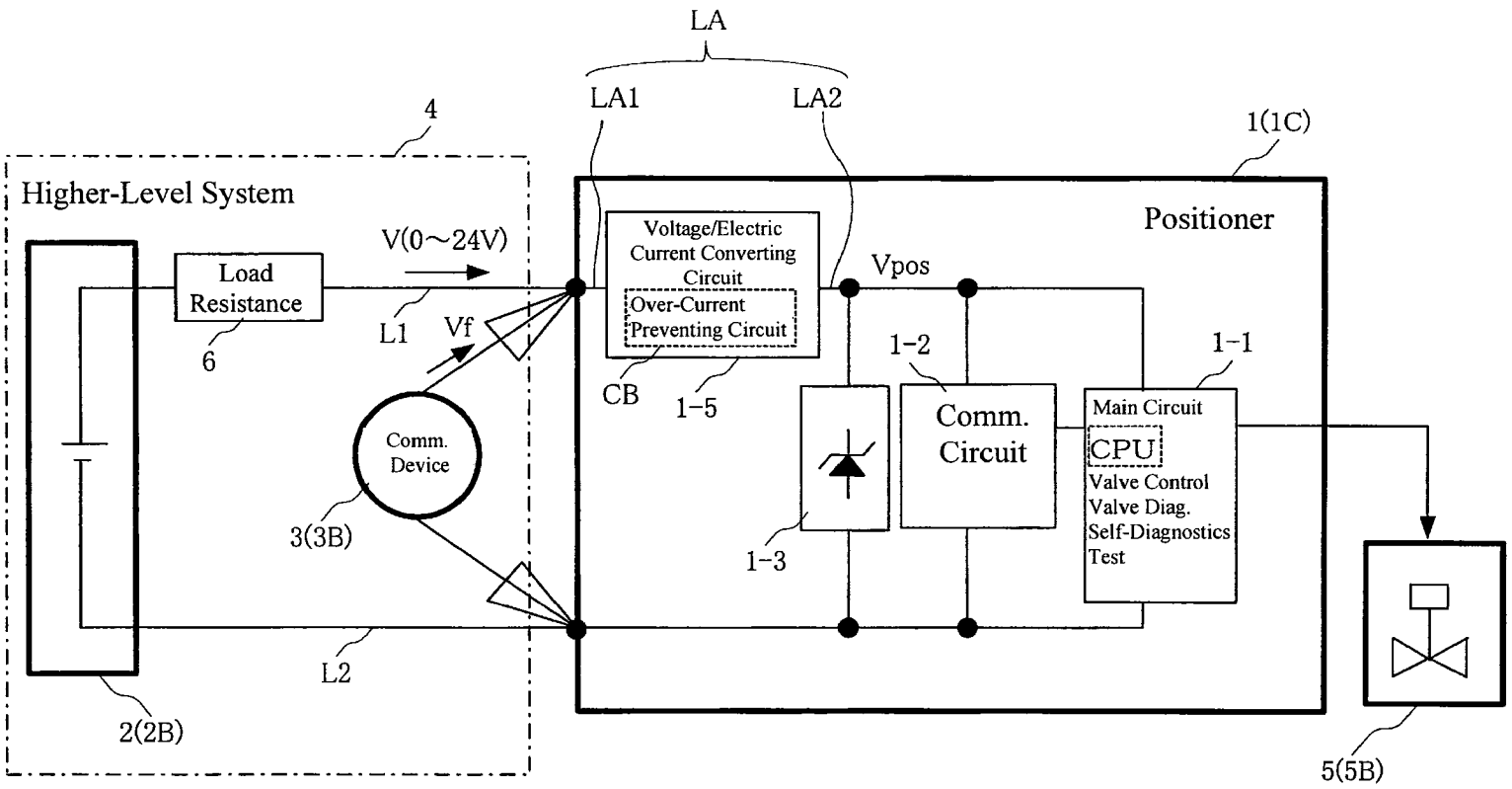
FIG. 1 is a diagram illustrating the structure of the critical components of a system that uses an example of a positioner according to the present invention.

FIG. 1 is a diagram illustrating the structure of certain components of a system that uses an example of a positioner according to the present invention. In this figure, codes that are the same as those in FIG. 9 indicate identical or equivalent structural elements as the structural elements explained in reference to FIG. 9, and explanations thereof are omitted.

Figure 9:
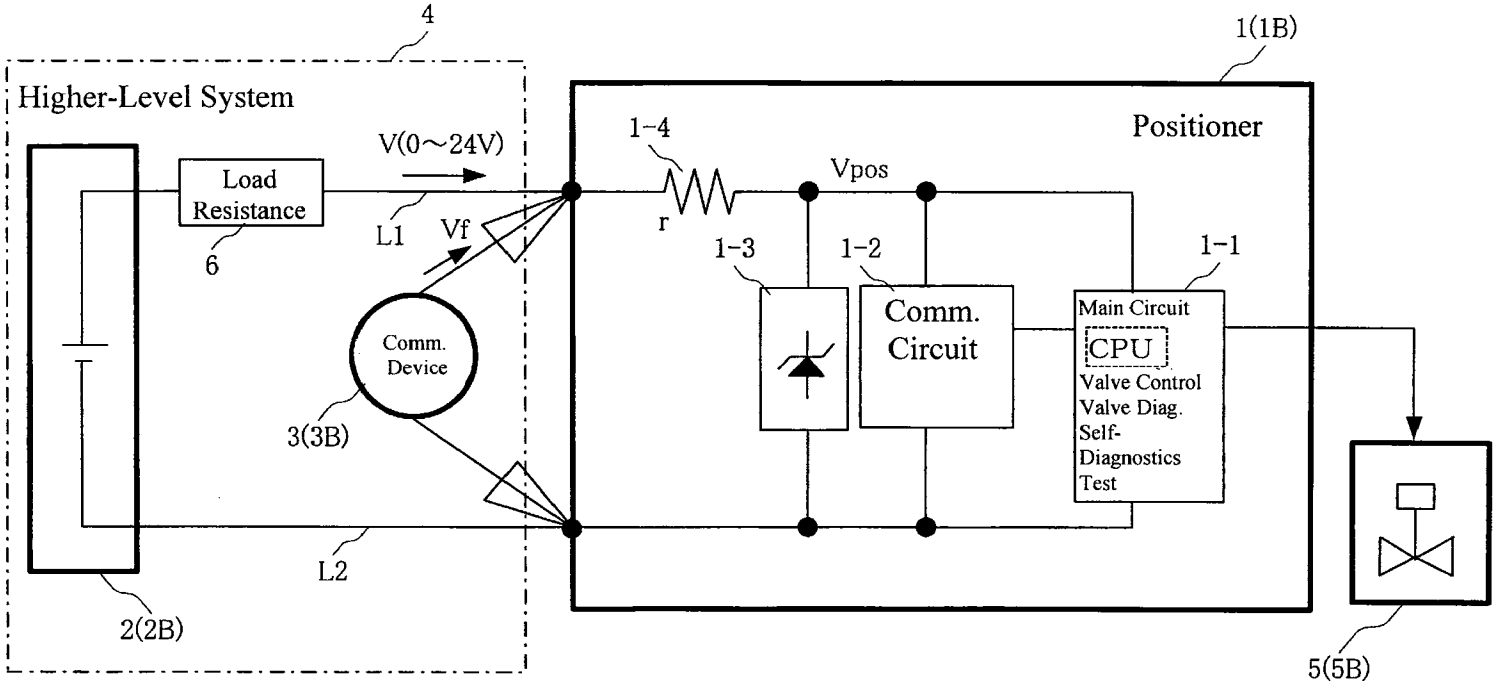
FIG. 9 is a diagram illustrating an example wherein a fixed resistor (with a small resistance value) is provided in a stage prior to the communication circuit of the electric current inputting-type positioner, to convert it into a voltage inputting-type positioner.
Figure 10:
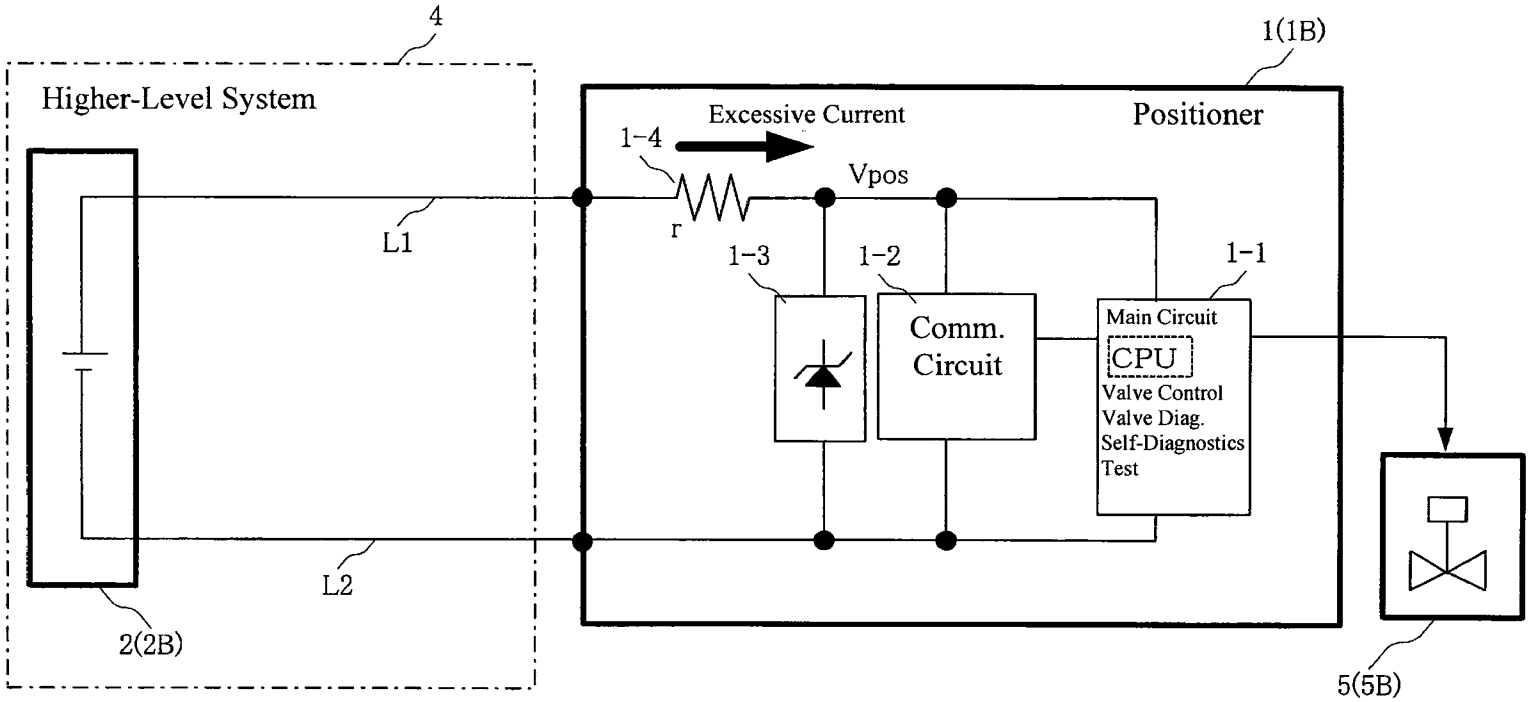
FIG. 10 is a diagram illustrating the state wherein this positioner is connected in error to the voltage supply side without connecting a load resistance.
Figure 11:
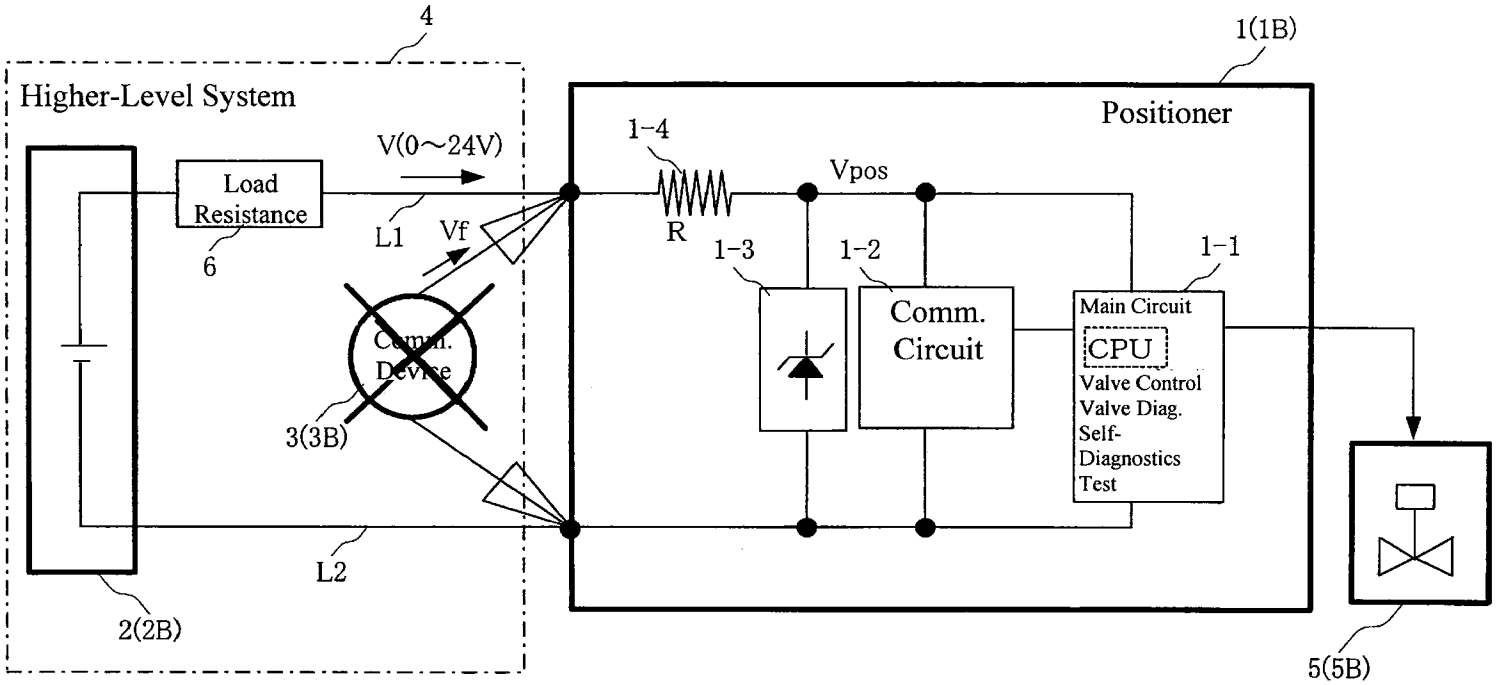
FIG. 11 is a diagram illustrating an example wherein a fixed resistor (with a large resistance value) is provided in a stage prior to the communication circuit of the electric current inputting-type positioner, to convert it into a voltage inputting-type positioner.

In the system, as can be understood from a comparison with the system illustrated in FIG. 9, a voltage/current converting circuit 1-5 is provided instead of the resistor 1-4 in the positioner 1 (1C). An over-current preventing circuit CB, for preventing an electric current above a specific electric current value, is included in the voltage/current converting circuit 1-5.

Figure 2:
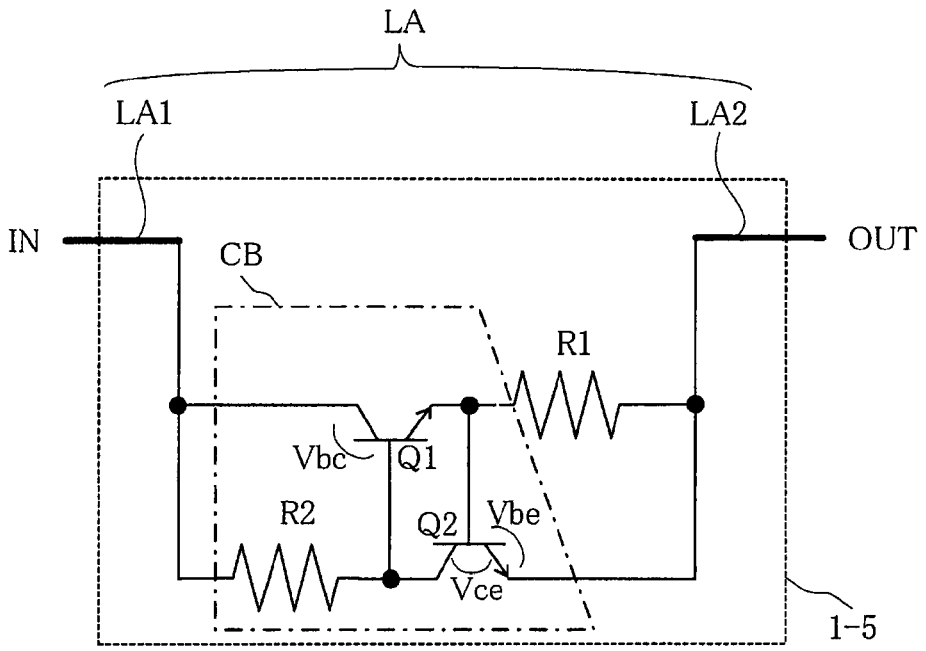
FIG. 2 is a diagram illustrating a circuit structure of a voltage/current converting circuit that is provided in a step prior to the communication circuit in a positioner in the present example.

FIG. 2 illustrates a circuit structure for the voltage/current converting circuit 1-5. This voltage/current converting circuit 1-5 is connected inserted into the lines LA that lead to the communication circuit, and is structured from a first transistor Q1 wherein the collector thereof is connected to the higher-level system side LA1 of the tines LA, a first resistor R1 having a resistance r1 that is connected on one end to the emitter of the first transistor Q1 and connected on the other end to the communication circuit side LA2 of the lines LA, a second resistor R2 that is connected on one end to the collector of the first transistor Q1 and connected on the other end to the base of the first transistor Q1 and a second transistor Q2 having the collector thereof connected to the other end of the second resistor R2, having a resistance of r2, the base thereof connected to the emitter of the first transistor Q1, and the emitter thereof connected to the other end of the first resistor R1.

Figure 3:
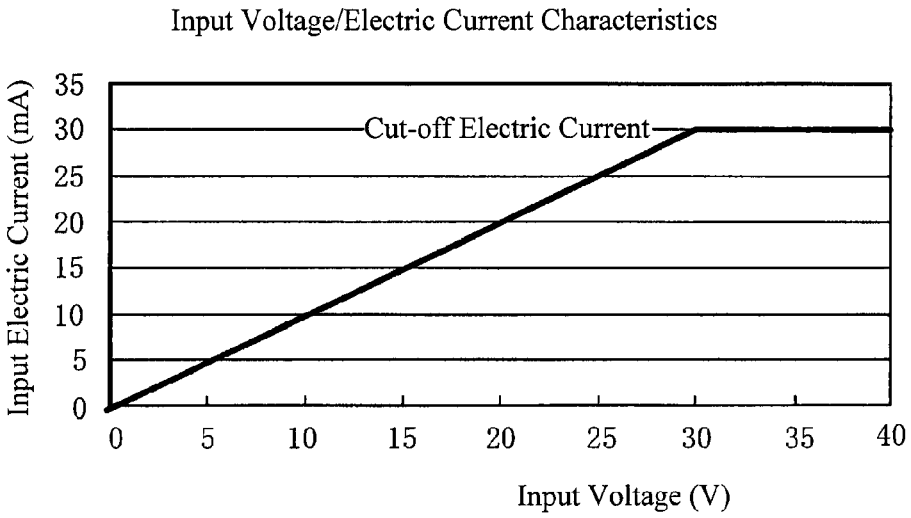
FIG. 3 is a diagram illustrating the input voltage-electric current characteristics of this voltage/current converting circuit.

Note that in this example, the resistance value r1 of the resistor R1 is 20Ω, the resistance value r2 of the resistor R2 is 10 KΩ, so that, through the effects of the transistors Q1 and Q2, described below, the electric current flows linearly up to 30 mA, as illustrated in FIG. 3, but when it reaches 30 mA, the electric current becomes saturated at 30 mA, and no electric current in excess thereof can be produced. That is, 30 mA used as the setting electric current value (the cutoff electric current), to prevent any electric current in excess of the setting electric current value from being produced.

In this case, in the voltage/current converting circuit 1-5, an electric current is produced in the path from the transistor Q1 to the resistor R1. Moreover, in this voltage/current converting circuit 1-5, the resistor R1 fulfills the role of converting the voltage to an electric current, where the circuit structure comprising the transistors Q1 and Q2 and the resistor R2, added to this resistor R1, structure an over-current preventing circuit CB.

In this positioner 1C, the DC voltage signal V from the higher-level device 2B is converted into an electric current by the resistor R1 in the voltage/current converting circuit 1-5, and sent to the main circuit 1-1. As a result, the main circuit 1-1 controls the opening/closing of the regulator valve 5B based on the value of the electric current that has been converted by the voltage/current converting circuit 1-5, that is, based on the value of the DC electric current signal V/r1.

Moreover, in this positioner 1C, the AC voltage signal Vf from the communication device 3B is converted into an electric current by the resistor R1 of the voltage/current converting circuit 1-5, and is sent to the electric current inputting-type communication circuit 1-2. In this case, not only is the incursion of the communication signal into the power supply side prevented through the load resistance 6 to which the lines the L1 are connected, but also the AC voltage signal Vf is converted into an AC electric current signal of essentially the same waveform in the voltage/current converting circuit 1-5, and sent to the electric current inputting-type communication circuit 1-2.

Figure 5:
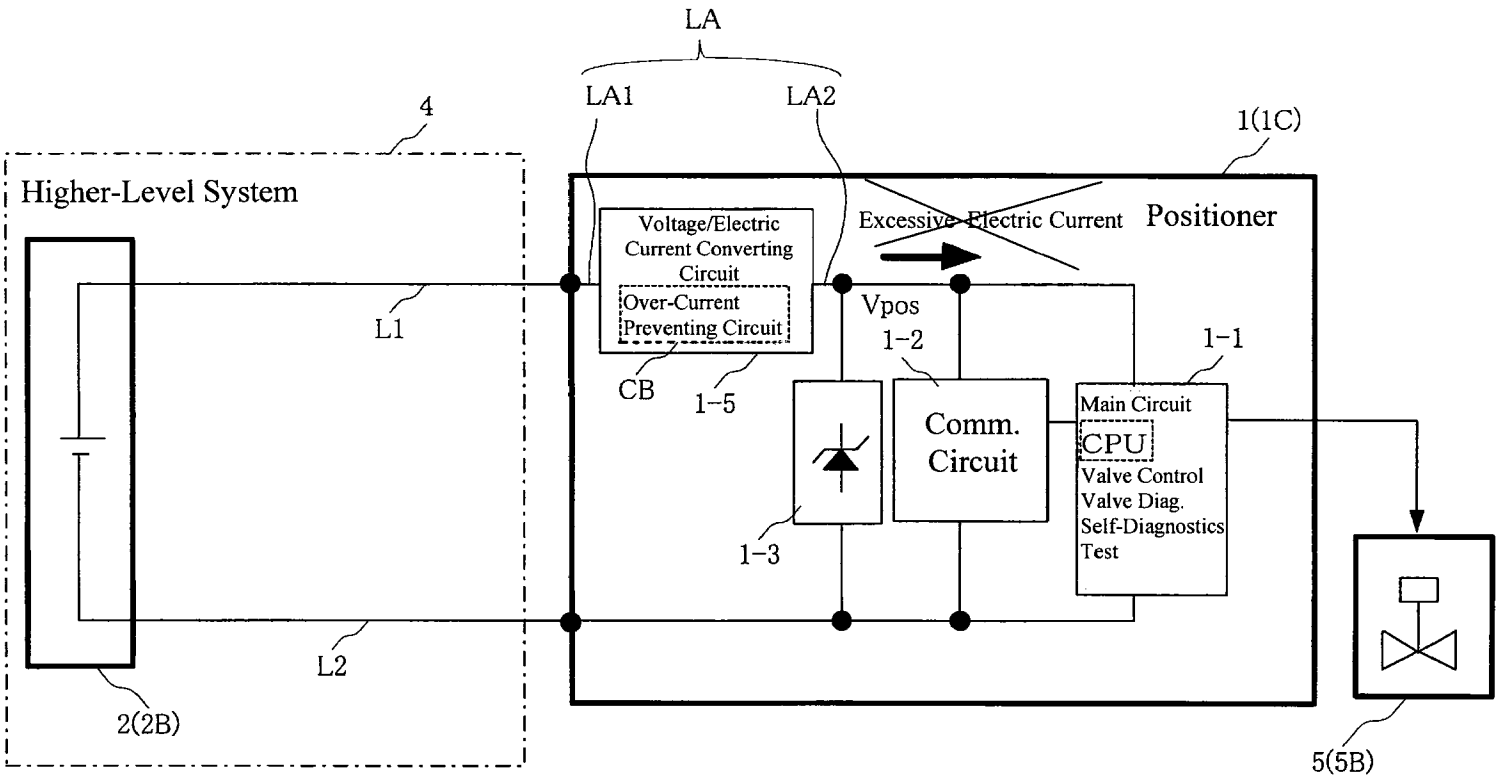
FIG. 5 is a diagram illustrating the state wherein a positioner that is provided with the voltage/current converting circuit is connected in error to the power supply side without a load resistance connected.

FIG. 5 shows the state wherein this positioner 1C is connected in error to the voltage source side without a load resistance 6 connected. In this case, the value of the resistor R1 in the voltage/current converting circuit 1-5 is small, and thus a large electric current flows into the internal circuitry of the positioner 1C. Here a collector current flows into the transistor Q1 prior to this in-flowing electric current reaching 30 mA, so does not flow to the transistor Q2 (where, with 20 Ω×29 mA=0.58 V, the transistor Q2 cannot operate with the Vbe less than 0.6 V, and thus the electric current does not flow in the transistor Q2). When this arrives at 30 mA, then 20 Ω×30=0.6 V, so the Vbe of the transistor Q2 goes to 0.6 V, starting the operation thereof, causing the Vce of the transistor Q2 to approach zero. This is equivalent to the Vbc of the transistor Q1 approaching zero, to be less than 0.6 V, and thus the transistor Q1 ceases to operate (turns OFF). By maintaining this balance, the electric current passing through the voltage/current converting circuit 1-5 is prevented from going higher than 30 mA.

Figure 8:
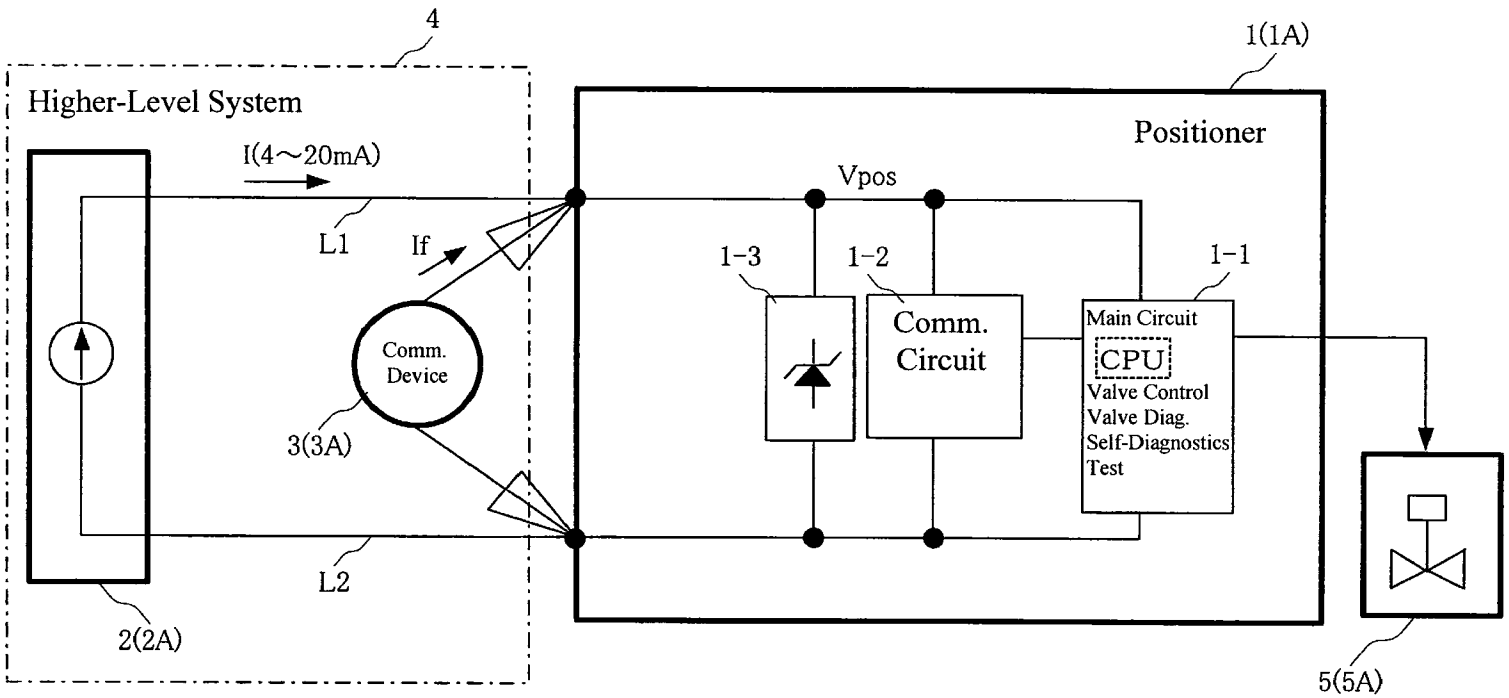
FIG. 8 is a diagram illustrating the structure of the critical components in a system that uses a positioner that has a function for communicating with the higher-level system.

In this way, in the present example, through merely providing the voltage/current converting circuit 1-5, which incorporates an over-current preventing circuit CB, into the stage prior to the communication circuit 1-2 in the typical electric current inputting-type positioner 1A that is illustrated in FIG. 8, the present example enables the provision of a voltage inputting-type positioner 1C of an inexpensive structure wherein there can be no excessively large electric current, and no impediment to communication, if connected in error to the voltage source without a load resistance 6 connected.

Note that while in the present example the electric current setting value for the over-current in the voltage/current converting circuit 1-5 was 30 mA, it need not necessarily be limited to 30 mA. For example, the electric current setting value for the over-current in the voltage/current converting circuit 1-5 may be set to 50 mA or the like, through changing the values of the resistors R1 and R2.

Figure 4:
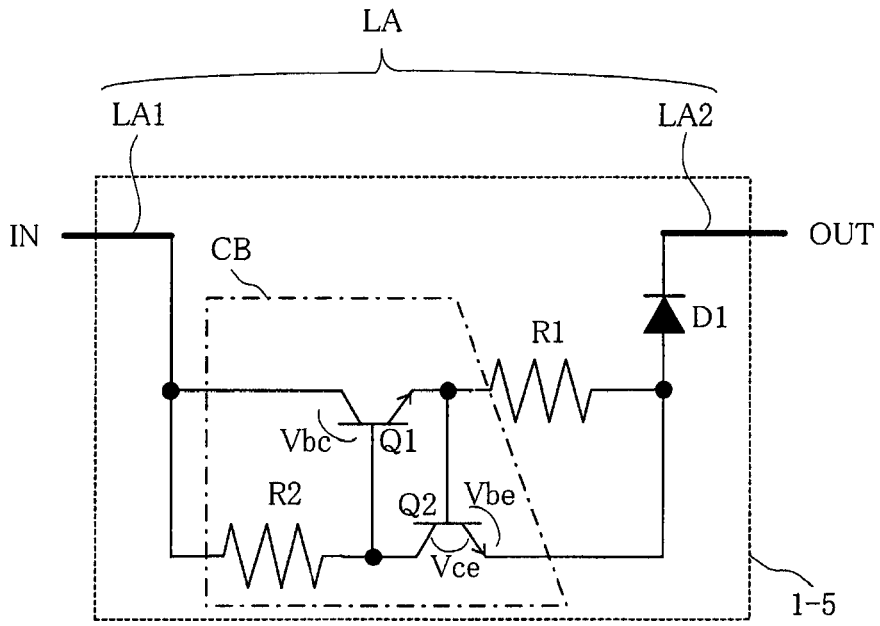
FIG. 4 is a diagram illustrating an example of the addition of a diode in the voltage/current converting circuit.

Moreover, as illustrated in FIG. 4, a diode D1 may be provided between the resistor R1 and the communication circuit side LA2 of the lines LA in the voltage/current converting circuit 1-5, In this case, the anode of the diode D1 can be connected to the other end of the resistor R1, and the cathode of the diode D1 can be connected to the communication circuit side LA2 of the lines LA. The provision of such a diode D1 makes it possible to prevent the flow of an excessive electric current to the internal circuitry of the positioner 1C, even if connected to the voltage source with the polarity inadvertently reversed.

The positioner 1C illustrated in FIG. 1 is used as a voltage inputting-type positioner. This voltage/current converting circuit 1-5 must be removed in order to make this positioner 1C into an electric current inputting-type. Given this, as illustrated in FIG. 6, in another example, a bypass circuit (a shorting circuit) 1-6 is provided in parallel with the voltage/current converting circuit 1-5, and a switch 1-7 is provided within the bypass circuit 1-6.

Figure 6:
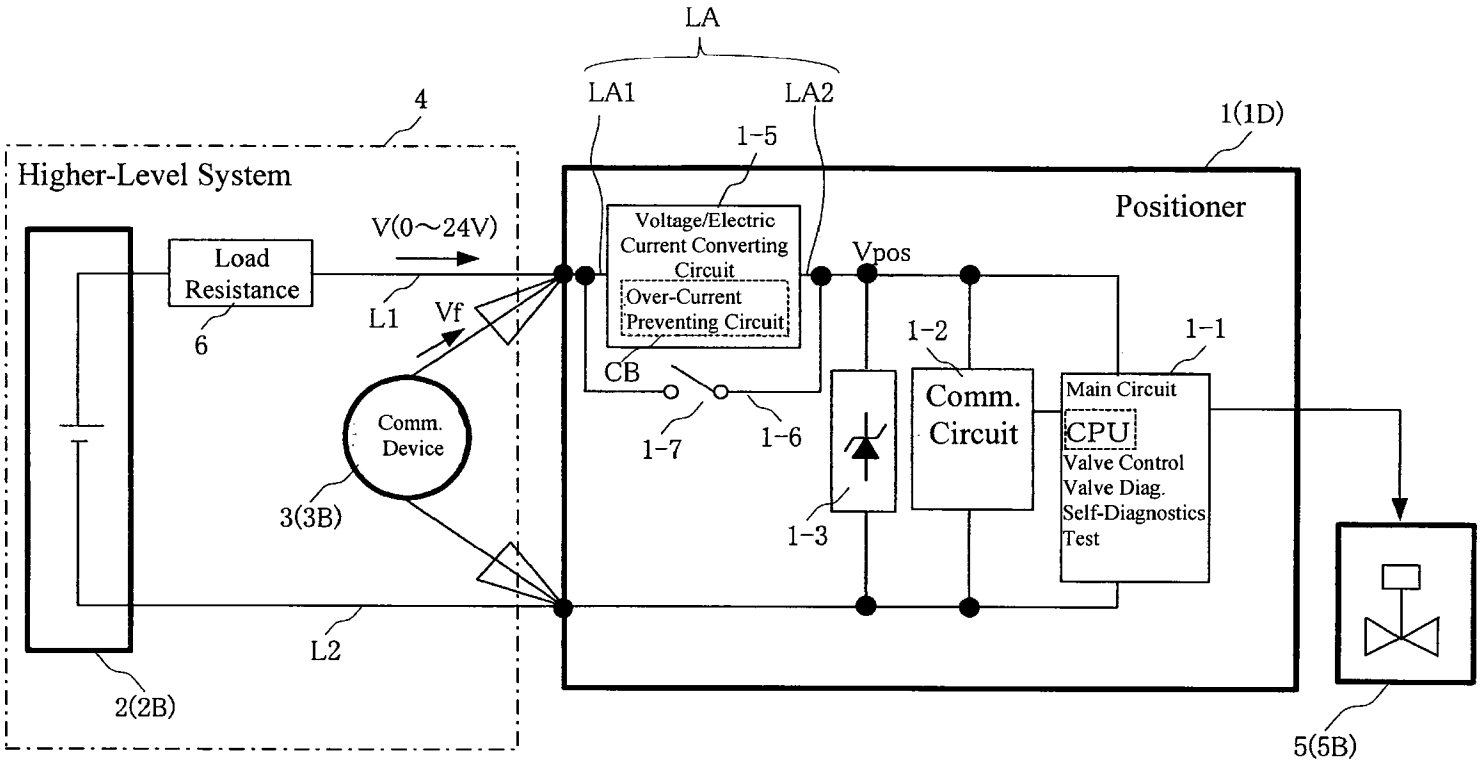
FIG. 6 is a diagram illustrating another example wherein a bypass circuit is provided, with a switch, in parallel to the voltage/current converting circuit.

When this positioner 1 (1D) is used as a voltage inputting-type positioner, then, as illustrated in FIG. 6, the switch 1-7 is turned OFF. Doing so disables the parallel connection of the bypass circuit 1-6 with the voltage/current converting circuit 1-5, causing the voltage/current converting circuit 1-5 to function, to produce the voltage inputting-type positioner.

Figure 7:
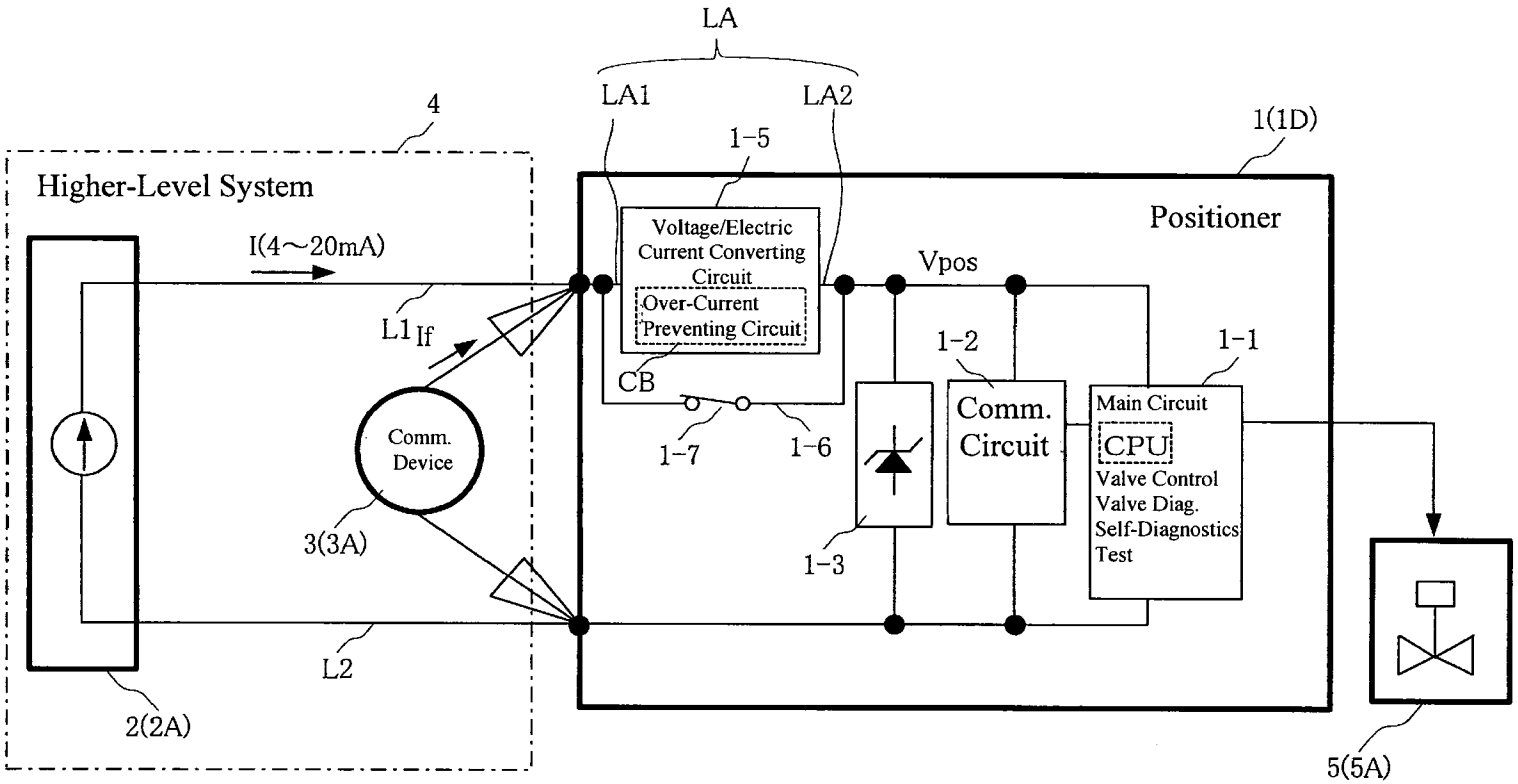
FIG. 7 is a diagram illustrating an example of use as an electric current inputting-type positioner by turning ON the switch in the bypass circuit that is provided in parallel to the voltage/current converting circuit.

In contrast, when this positioner 1D is used as an electric current inputting-type positioner, then, as illustrated in FIG. 7, the switch 1-7 is turned ON. Doing so enables the parallel connection of the bypass circuit 1-6 with the voltage/current converting circuit 1-5, causing the voltage/current converting circuit 1-5 to not function, to produce the electric current inputting-type positioner.

Note that while in the examples set forth above, the regulator valve 5B was an electromagnetic valve, instead the system for providing the power supplies to the positioners 1C and 1D may use a field bus system, and the regulator valve 5B may be a proportional valve.

Moreover, while in the examples set forth above, the communication device 3 was connected, as necessary, between the transmission lines L1 and the L2, the system may instead be one wherein the communication is performed between the higher-level device 3 and the positioner 1.

The positioner according to the present invention can be used in a variety of fields, such as process control, for controlling the opening of a regulator valve.

The invention claimed is:

1. A positioner receiving a DC electric signal through a pair of electric wires from a higher-level system to produce its own operating power supply from the DC electric signal that is supplied, and controlling the degree of opening of a regulator valve in accordance with a value of the supplied DC electric signal, comprising:

a current inputting-type communication circuit receiving an AC electric signal sent from the higher-level system superimposed on the DC electric signal; and a voltage/current converting circuit, provided in a stage prior to the communication circuit, converting the voltage into an electric current and sending the electric current to the communication circuit if the DC electric signal from the higher-level system is a voltage;

wherein the voltage/current converting circuit is provided with an over-current preventing circuit preventing the flow of an electric current higher than a specific electric current value.

2. The positioner as set forth in claim 1, comprising:

a bypass circuit connected in parallel with the voltage/current converting circuit; and a switch enabling/disabling the parallel connection of the bypass circuit with the voltage/current converting circuit.

3. The positioner as set forth in claim 1, wherein:

the voltage/current converting circuit is connected in a line to the communication circuit; and comprises:

a first transistor wherein a collector thereof is connected to the higher-level system side of the line;

a first resistor having one end thereof connected to an emitter of the first transistor and the other end thereof connected to the communication circuit side of the lines;

a second resistor having one end thereof connected to the collector of the first transistor and the other end thereof connected to a base of the first transistor; and a second transistor, having a collector thereof connected to the other end of the second resistor, a base thereof connected to an emitter of the first transistor, and an emitter thereof connected to the other end of the first resistor.

4. The positioner as set forth in claim 1, wherein:

the voltage/current converting circuit is inserted in a line to the communication circuit; and comprises:

a first transistor wherein the collector thereof is connected to the higher-level system side of the line;

a first resistor having one end thereof connected to an emitter of the first transistor;

a diode having the anode thereof connected to the other end of the first resistor and the cathode thereof connected to the communication circuit side of the lines;

a second resistor having one end thereof connected to a collector of the first transistor and the other end thereof connected to a base of the first transistor; and a second transistor, having a collector thereof connected to the other end of the second resistor, a base thereof connected to an emitter of the first transistor, and an emitter thereof connected to the other end of the first resistor.

* * * * *